United States Patent [19]

Claiborne

[11] 4,052,321

[45] Oct. 4, 1977

[54] FLAME-RETARDANT YARN OR THREAD CONTAINING BROMINATED ESTER OF OLEIC OR LINOLEIC ACID

[75] Inventor: Jefferson Lyle Claiborne, Hexson, Tenn.

[73] Assignee: Dixie Yarns, Inc., Chattanooga, Tenn.

[21] Appl. No.: 667,659

[22] Filed: Mar. 17, 1976

[51] Int. Cl.[2] ..... D06M 13/20

[52] U.S. Cl. ..... 252/8.6; 8/115.6; 252/56 R; 252/58; 260/408

[58] Field of Search ..... 252/8.6, 56 R, 58; 8/115.6; 260/408

[56] References Cited

U.S. PATENT DOCUMENTS

| | | | |
|---|---|---|---|
| 3,223,623 | 12/1965 | Kubitz | 252/8.6 |
| 3,240,794 | 3/1966 | Bornfleth | 260/408 |
| 3,288,822 | 11/1966 | Hall et al. | 260/404 |
| 3,575,856 | 4/1971 | Anton | 252/8.9 |
| 3,652,419 | 3/1972 | Karg | 252/8.8 |
| 3,687,721 | 8/1972 | Dardoufas | 117/138.8 F |

OTHER PUBLICATIONS

The Condensed Chemical Dictionary, 8th Edition, 1971.

*Primary Examiner*—John Kight, III

*Attorney, Agent, or Firm*—Stevens, Davis, Miller & Mosher

[57] ABSTRACT

A flame-retardant yarn or thread containing a flame retardant lubricant, which is a brominated ester of oleic or linoleic acid, is disclosed. The esters are brominated at those portions of the ester having original ethylenic unsaturation and function both as a lubricant and a flame retardant.

16 Claims, No Drawings

FLAME-RETARDANT YARN OR THREAD CONTAINING BROMINATED ESTER OF OLEIC OR LINOLEIC ACID

BACKGROUND OF THE INVENTION

The present invention relates to lubricants for sewing threads and primarily to a flame retardant lubricant for use on a sewing thread employed in manufacturing nonflammable garments.

In the past, there have been a number of problems associated with the manufacture of nonflammable apparel, not the least of which related to the sewing thread employed in manufacturing such garments. Sewing threads require some type of lubrication in order to sew properly and to protect the thread from deteriorating due to the heat of friction created as the thread passes through the needle of the sewing machine. Most lubricants known in the trade today, however, are flammable and even the small amount of lubricant used, which may constitute from 2 to 10% of the total weight of the sewing thread, is so flammable that flammability of the seam occurs with the result that the original object, i.e., to have a nonflammable garment, is for all practical purposes destroyed.

This problem is further complicated by the fact that sewing threads currently in use for manufacturing nonflammable garments are generally of synthetic materials which exhibit thermoplastic properties. Such threads require even better lubrication than natural threads to ensure against needle burn.

It is therefore necessary and desirable in the manufacture of nonflammable apparel, to employ a sewing thread lubricated with a flame retarded lubricant. Such flame retardant lubricants known to the inventor in the past have been ordinary lubricants such as esters, mineral oils, paraffins, and other fatty acid derivatives which, although flammable in themselves, can be rendered nonflammable by the addition of fire-retardant materials such as compounds of halogens and phosphorus. These materials are only make-shifts, however, and the actual lubrication component is itself still flammable. Furthermore, the nonflammable portion of the combination generally has substantial nonlubricating properties which limit the lubrication value of the composite lubricant since the nonflammable portion often comprises as much as 8 or 10% of the total mixture.

In view of these difficulties with known lubricants, it was desirable to find a lubricant that had both lubricating and flame-retardant properties. It was discovered by this inventor that certain polybrominated esters of or compounds containing oleic or linoleic acid could be used for such a purpose.

SUMMARY OF THE INVENTION

Broadly stated, this invention comprises a flame-retardant yarn or thread primarily for use in sewing flame-retardant apparel and the like. The capability of the yarn or thread to be used in flame retardant apparel is enhanced by a flame-retardant lubricant which is a polybrominated ester of the formula $$R_1-\underset{\underset{O}{\|}}{C}-O-R_2$$

wherein $$R_1-\underset{\underset{O}{\|}}{C}-O-$$

is a dibrominated oleic or linoleic acid moiety and $R_2$ is an unsubstituted, dibrominated, or tetrabrominated straight or branched chain saturated aliphatic group having from 1 to about 20 carbon atoms or $$H-(OR_3)_x-$$

wherein $R_3$ is an alkylene group having 2 to 3 carbon atoms and $x$ is a number from 1 to about 25 and glycerol sans a hydroxyl group.

Other compounds which are contemplated for use in the present invention are hexabromo glycerol trioleate, hexabromo sorbitan trioleate, and tetrabromo polyethylene glycol dioleate, and brominated lecithin.

The polybrominated ester contains from 2 to 6 bromine groups, depending upon the number of available sites for bromination provided by the constituents used to form the base ester. If the material supplying the alcoholic moiety is saturated, then the ester would be dibrominated as a result of the two available sites for bromination supplied by the unsaturated linkage in the oleic or linoleic acid group. If, on the other hand, the group supplying the ester moiety is a monoethylenically unsaturated group, such as an oleate, the resulting ester would be tetrabrominated since there are two available sites for bromination in the acid portion of the ester and two available sites for bromination in the alcoholic portion. If the alcohol moiety is provided by a diethylenically unsaturated material, then there are a total of six bromine atoms present in the final ester of the flame-retardant lubricant employed in the present invention.

Representative groups of $R_2$ are methyl, n-propyl, isopropyl, hexyl, octyl, decyl, dodecyl, tetradecyl, pentadecyl, stearyl and eicosyl, dibromo butyl, dibromo pentyl, tetrabromo octyl, dibromodecyl and tetrabromyl heptadecyl. The bromine-containing groups are based upon a corresponding monoethylenically or diethylenically unsaturated material, e.g., oleate, which is brominated at its point(s) of unsaturation.

If $R_2$ is an oxyalkylene glycol, the oxyalkylene group can be oxyethylene or oxypropylene with the amount of oxyalkylene units present ranging from 1 up to about 25.

Compounds useful in the practice of the present invention are tetrabromo oleyl oleate, dibromo n-propyl oleate, dibromo isopropyl oleate, dibromo methyl linoleate, dibromo n-butyl oleate, dibromoglycerol oleate, dibromo methyl oleate, dibromo stearyl oleate, dibromo ($C_{14}$–$C_{15}$) oleate (mixture of tetradecyl and pentadecyl), hexabromo glycerol trioleate, hexabromo sorbitan trioleate, tetrabromo polyethylene glycol dioleate and brominated lecithin.

Particularly preferred embodiments of the present invention include tetrabromo oleyl oleate, dibromo propyl oleate and dibromo polyethylene glycol oleate wherein the polyethylene glycol portion of the ester has a molecular weight of about 400.

The flame-retardant lubricant can be applied to the thread or yarn in any desired amount providing it supplies the desired flame retardancy and lubricating properties. A preferred and conventional range of application is from about 2 to about 10% by weight based upon the weight of the thread.

The yarns or threads treated in accordance with the present invention are conventional materials such as polyester although any yarn or thread can be employed as long as it needs to be coated with a lubricant that should itself be flame-retardant.

In order to show the nature of the hereindescribed invention, reference is made to the following examples.

EXAMPLE 1

Brominated propyl oleate was applied to a 100% polyester sewing thread and compared with a non-brominated control for flammability.

Extraction results on the thread after application shows 12.4% extract. Friction tests against steel indicated a coefficient of friction ($\mu$) of 0.141. Flammability tests on a fabric knit from the thread having propyloleate applied thereto gave RF of O and Cl of 3.1 inches (average). The results of the thread and knit having propyl oleate applied thereto were a coefficient of friction ($\mu$) of 0.130, and flammability tests results are RF of O and Cl of 3.6 inches (average).

EXAMPLE 2

A brominated oleyl oleate was tested in the same manner as described in Example 1 and compared with a non-brominated oleyl oleate used as a control. The test data shows a coefficient of friction ($\mu$) of 0.172 for the brominated and a coefficient of friction ($\mu$) of 0.119 for the non-brominated control.

The flammability test on fabrics knit from the two oleates were inconclusive because the fabrics pulled away from the flame without igniting. However, pieces of glass fabric were dipped into each of the two oleates and ignited. The non-brominated oleyl oleate burned readily whereas the tetrabrominated oleyl oleate-dipped fabric ignited and then quickly extinguished. This type of testing was repeated for several times with the same results each time, indicating that the tetrabrominated oleate is self-extinguishing.

Similar results are achieved when using oxyalkylene containing brominated esters of linoleic and oleic acid.

Having described the invention as above, it is apparent that modifications and changes can be made therein without departing from the scope of the invention which is set out in the appended claims.

What is claimed is:

1. A flame-retardant yarn or thread, comprising a yarn or thread having applied thereto a flame-retardant lubricant which is a polybrominated ester selected from (1) compounds of the formula $$R_1-\underset{\underset{O}{\|}}{C}-O-R_2$$

wherein $$R_1-\underset{\underset{O}{\|}}{C}-O$$

is a dibrominated oleic or linoleic acid moiety and $R_2$ is selected from the group consisting of unsubstituted, dibrominated, or tetrabrominated straight or branched chain saturated aliphatic groups having from 1 to about 20 carbon atoms;

$$H-(OR_3)_x-$$

wherein $R_3$ is an alkylene group having 2 to 3 carbon atoms and $x$ is a number from 1 to about 25 and glycerol sans a hydroxyl group;

2. hexabromo glycerol trioleate, (3) hexabromo sorbitan trioleate, (4) tetrabromo polyethylene glycol dioleate, (5) tetrabromo polyethylene glycol dioleate and (6) brominated lecithin.

2. The flame-retardant yarn of thread of claim 1 wherein the lubricant is tetrabromo oleyl oleate.

3. The flame-retardant yarn or thread of claim 1 wherein the lubricant is dibromo propyl oleate.

4. The flame-retardant yarn or thread of claim 1 wherein the lubricant is dibromo polyethylene glycol oleate wherein the polyethylene glycol moiety has a molecular weight of about 400.

5. The flame-retardant yarn or thread of claim 1 wherein the lubricant is dibromoglycerol mono-oleate.

6. The flame-retardant yarn or thread of claim 1 wherein the lubricant is hexabromoglycerol trioleate.

7. The flame-retardant yarn or thread of claim 1 wherein the lubricant is hexabromo sorbitan trioleate.

8. The flame-retardant yarn or thread of claim 1 wherein the lubricant is tetrabromo polyethyleneglycol dioleate.

9. The flame-retardant yarn or thread of claim 1 wherein the lubricant is brominated lecithin.

10. The flame-retardant yarn or thread of claim 1 wherein the lubricant is applied in an amount of about 2 to about 10% by weight based upon the weight of the yarn or thread.

11. The flame-retardant yarn or thread of claim 1 wherein the yarn or thread is polyester.

12. The flame-retardant yarn or thread of claim 1 wherein the lubricant is dibromo methyl linoleate.

13. The flame-retardant yarn or thread of claim 1 wherein the lubricant is dibromo n-butyl oleate.

14. The flame-retardant yarn or thread of claim 1 wherein the lubricant is dibromo methyl oleate.

15. The flame-retardant yarn or thread of claim 1 wherein the lubricant is dibromo stearyl oleate.

16. The flame-retardant yarn or thread of claim 1 wherein the lubricant is dibromo ($C_{14}$–$C_{15}$) oleate.

* * * * *